United States Patent [19]

Garlaschi

[11] 4,397,172

[45] Aug. 9, 1983

[54] TWO-DIE, FOUR-PUNCH PRESS FOR THE PRODUCTION OF SCREWS, BOLTS, RIVETS AND LIKE ARTICLES

[76] Inventor: Eufemia Garlaschi, Via Victor Hugo 4, Milan, Italy

[21] Appl. No.: 242,150

[22] Filed: Mar. 9, 1981

[30] Foreign Application Priority Data

Dec. 19, 1980 [IT] Italy ..... 26817 A/80

[51] Int. Cl.[3] ..... B21D 22/00

[52] U.S. Cl. ..... 72/356; 10/12 T; 10/12.5; 10/15

[58] Field of Search ..... 72/356; 10/11 R, 11 A, 10/12 R, 12 T, 12.5, 13, 15

[56] References Cited

U.S. PATENT DOCUMENTS

| | | | |
|---|---|---|---|
| 2,362,970 | 11/1944 | Bolland | 10/12.5 |
| 3,353,417 | 11/1967 | Nebendorf et al. | 10/12.5 |
| 3,470,727 | 10/1969 | Byorn et al. | 72/403 |
| 3,755,839 | 9/1973 | Emody et al. | 10/15 |
| 4,170,051 | 10/1979 | O'Keefe et al. | 10/12.5 |
| 4,170,123 | 10/1979 | Berger | 72/356 |

*Primary Examiner*—Leon Gilden

*Attorney, Agent, or Firm*—Stevens, Davis, Miller & Mosher

[57] ABSTRACT

In a two-die, four-punch press for the production of screws, bolts, rivets and like shaped articles, the four punches are mounted on a swinging plate which is borne frontally by the ram. The swinging motion of the punch-carrier plate is controlled by a desmodromic (positive) cam which, through an intermediary mechanism, commands the tail piece of the plate mounted in the ram with an axis parallel to the direction of travel of said ram.

3 Claims, 11 Drawing Figures

10
11
12
13
14
15
16
17
18
19
20
21

TWO-DIE, FOUR-PUNCH PRESS FOR THE PRODUCTION OF SCREWS, BOLTS, RIVETS AND LIKE ARTICLES

This invention relates to a press having two dies and four punches for the production of screws, bolts, rivets and like shaped articles.

The production of screws, bolts, rivets and other shaped articles is carried, as a rule, on presses having one die and two punches.

In order to permit the performance of more intricate works which cannot be done in two operative stages only, multiple cold presses have been provided, having a number of dies and a number of punches, the number of the dies being the same as the number of punches. More particularly, there have already been suggested presses which operates with two dies and four punches. Such presses had the four punches borne by a plate slidably mounted on ways formed on the press ram. The advantage of such a kind of a press is the fact that it becomes possible, with sequential ram blows, to effect four operations on a workpiece which, after having undergone the first two operations in the first die, is switched to the second die to undergo the remaining two operations therein. To every active stroke of the ram there correspond two operations which are simultaneously performed by two punches.

This conventional type of press having two dies and four punches did not find a wide acceptance in practice due to its intricacy and to the circumstances that the linkages used to control it did not permit the attainment of high speeds, which, on the contrary, are in keener and keener demand for presses of the kind referred to.

Thus, the technical art has passed to adopt presses having two dies and three punches, which permit to produce various special items, the constructions of the implements being thus simplified. However, in this kind of press, in every second active stroke of the ram, a single punch carries out a processing step. This fact originates unbalances in the lateral stresses to which the press is subjected during its operation.

An object of the present invention is thus to provide a press having two dies and four punches which is capable of carrying out even intricate operations without impairing the production speed, such operations being practicable heretofore only on much more intricate presses and at production speeds which were much slower.

By way of example, among the operations which involved intricacies as intended in this specification, one might cite those of the production of particular items having varied shapes, with engravings on the heads of the screws or bolts, production of half-bored rivets having sturdy heads, fully bored rivets having very massive heads and particular shapes, such as gears and the like.

To face the problem posed by this invention, it has been envisaged, at the outset, to adopt, as the supporting member for the four punches on the ram, rather than a plate slidable on ways, which, of necessity, must be very sturdy and require great masses in motion and thus low speeds, a punch-carrier plate of swingable type, conventionally known in the presses having a smaller number of punches. This expedient permits that a very robust rotation tail-piece may be adopted for the supporting member, having comparatively lightweight peripheral parts, a considerable speed increase being thus made possible.

However, the adoption of a swingable punch-carrier plate, as such, is not capable of solving the problem, especially with respect to the required speed increase and the necessary high accuracy.

In order that such an object may be achieved, the present invention has provided a particular device for the control of the punch-carrier swinging plate which is mainly characterized in that it receives the drive from a rotary shaft of the press through a so-called desmodromic (positive) cam, that is, via a cam having two mutually complementary profiles on which two followers roll, which are carried by a forked lever which, by rocking about a pivotal point, transfers the drive via appropriate transfer members and at an accurately controlled speed to the tail-piece of the punch-carrier plate, said tail-piece being supported in the ram.

The rocking motion of said plate is thus univocally bound to the rotation of the control shaft of the press, without any possibility of skiddings and without using any resilient means, so that such rocking motion is accurately controlled even at the highest speeds.

The difficulties for constructing a desmodromic linkage requiring a very high accuracy, and thus is very expensive, are well known. For this reason, thus, such a desmodromic (positive) linkage is usually adopted only in a high-accuracy machinery only. In order that the adoption of such an approach may become economically acceptable, according to a preferred embodiment of this invention, the two followers which contact the profiles of the desmodromic cam are mounted on eccentric pins which make a certain adjustment and a certain preloading possible, in addition to allowing to take up possible backlash.

The features of the invention along with the advantages stemming therefrom will become clearer from the ensuing detailed description of a press having two dies and four punches constructed according to the present invention, said description being aided by the accompanying drawings, wherein.

Figures 1, 2, 3, 4, 5, 6:
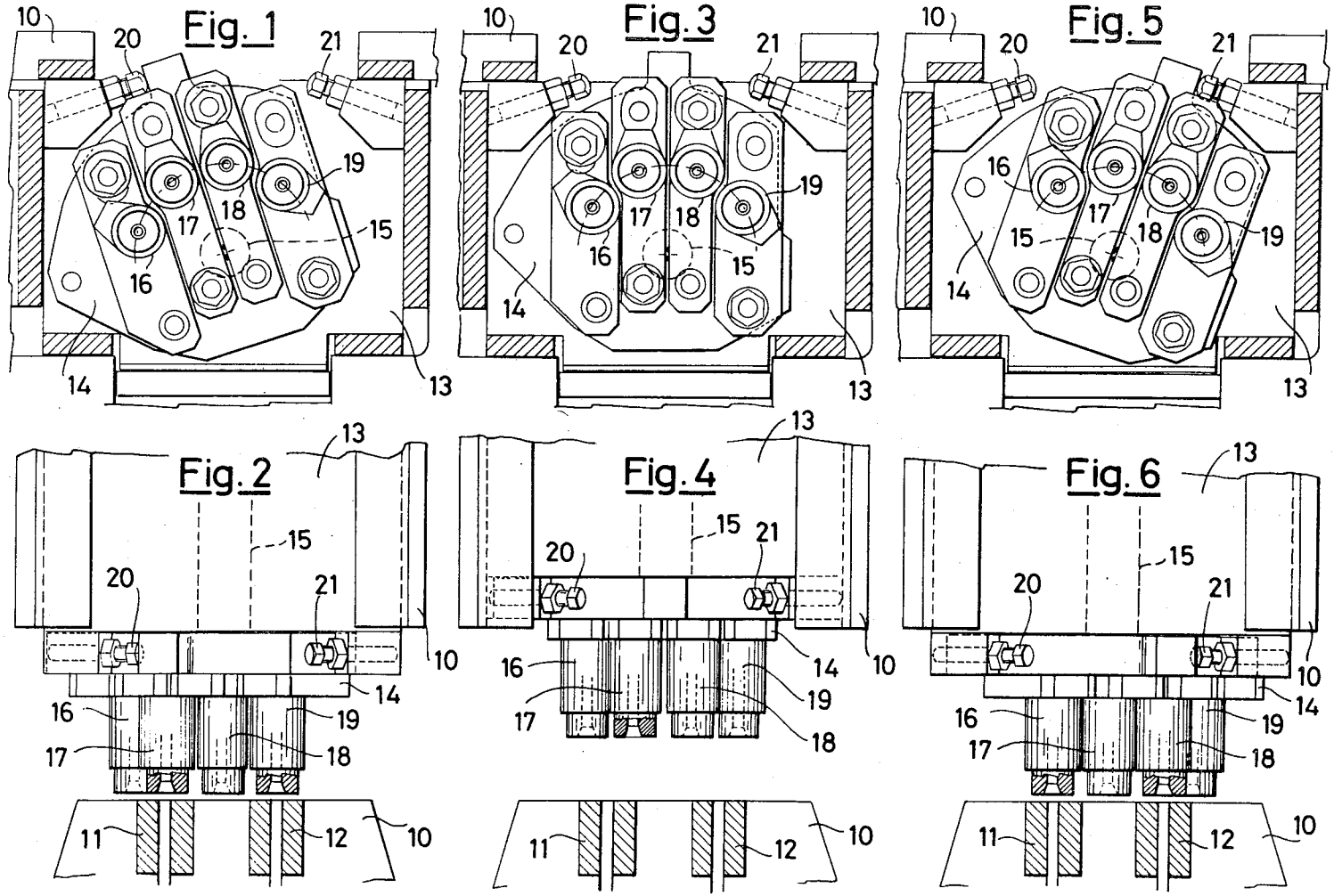
FIGS. 1 and 2 show diagrammatically in front view the ram with the punch-carrier swingable plate and, in plan view, respectively, the same ram confronting the two press punches, in a first operative position.
FIGS. 3 and 4 are views akin to those of FIGS. 1 and 2, but with the punch-carrier plate in an intermediate transitional position.
FIGS. 5 and 6 are views akin to those of FIGS. 1 and 2, but with the punch-carrier plate in its second working position.

Having now reference, at the outset, to the diagrammatical views of the FIGS. 1 to 6 inclusive, it can be seen that the press comprises a baseplate or casing 10 in which, on a side are mounted the two dies 11 and 12 and, on the other side, the ram 13 is properly guided. Frontally of the ram 13, there is supported thereby a swinging plate 14 by the agency of a tail-piece 15 integral with said plate and such a plate 14 carries four punches 16, 17, 18 and 19.

The swinging plate 14 can angularly be shifted about the axis of its tail-piece 15 between two end working positions as embodied by two adjustable abutments 20 and 21 mounted on the ram 13.

In either position (FIGS. 1 and 2) the punches 17 and 19 are aligned, respectively, with the axes of the dies 11 and 12, whereas, in the other position (FIGS. 5 and 6), the punches 16 and 18 are aligned with the axes of the dies 11 and 12, respectively. FIGS. 3 and 4, instead, show an intermediate transitional position of the swinging plate 14 from the one end working position to the other.

When the ram 13 makes a first blow or work stroke, the punches 17 and 19 are both active and, when it makes the following blow, the workpiece is transferred with conventional means (not shown) from the first die, for example from die 12, to the second die, for example die 11.

To produce the rocking motion of the swinging plate 14 about the axis of its tail-piece 15, means are provided, according to the invention, to be described in more detail hereinafter.

Figure 7:
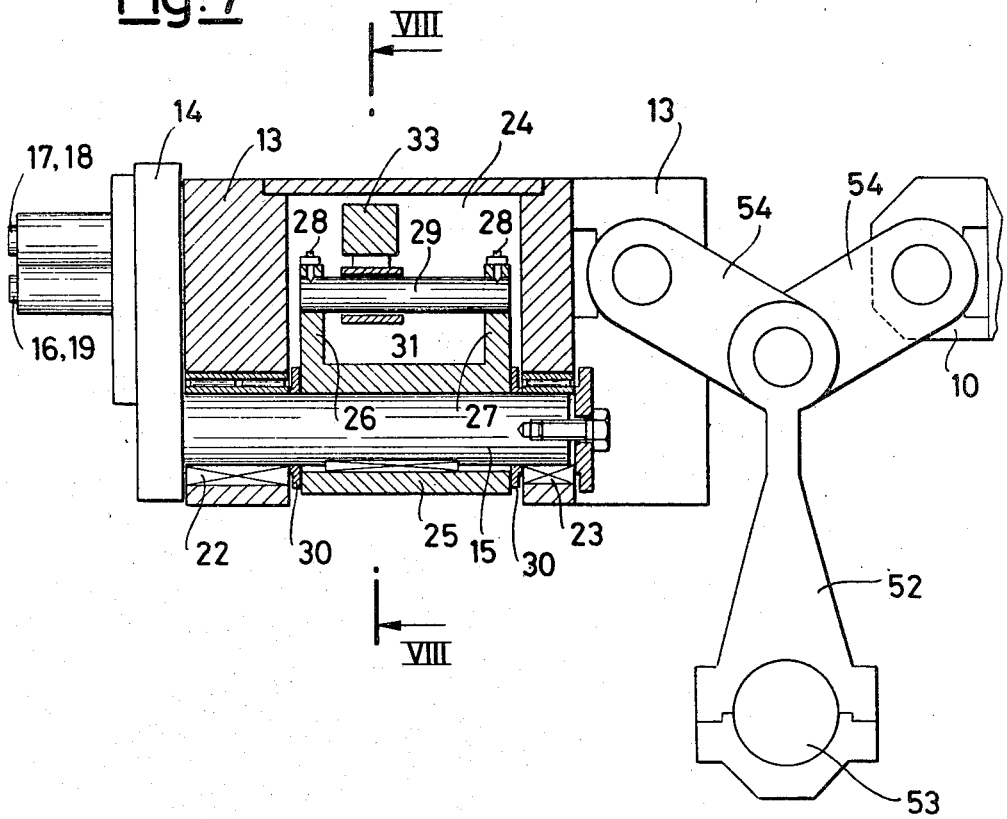
FIG. 7 is a central vertical cross-sectional view of the ram, taken along the line VII—VII of FIG. 8 and shows also the actuating means for said ram.
Figure 10:
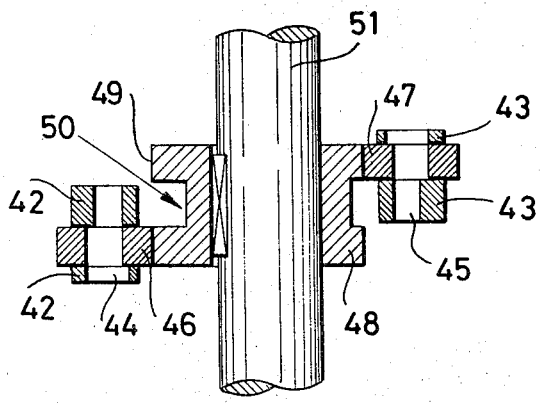
Figure 11:
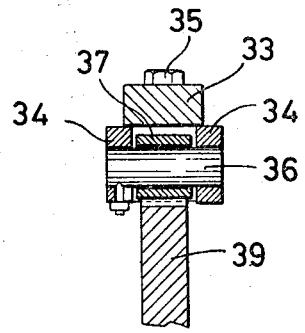

The tail-piece of the swinging plate 14 is supported for rotation by bearings 22, 23 in the ram 13 and the axis of the tail-piece 15 is exactly parallel to the direction of sliding of the ram (FIG. 7).

To the tail-piece 15, in a specially provided space 24 of the ram 13, is bolted a tubular bracket 25 having two rungs 26, 27: these carry, properly secured by screws 28, a pivot 29 which is arranged exactly parallel to the axis of the tail-piece 15.

The tubular bracket 25 is positioned between two spacers 30 and is rotated concurrently with the tail-piece 15.

Figure 8:
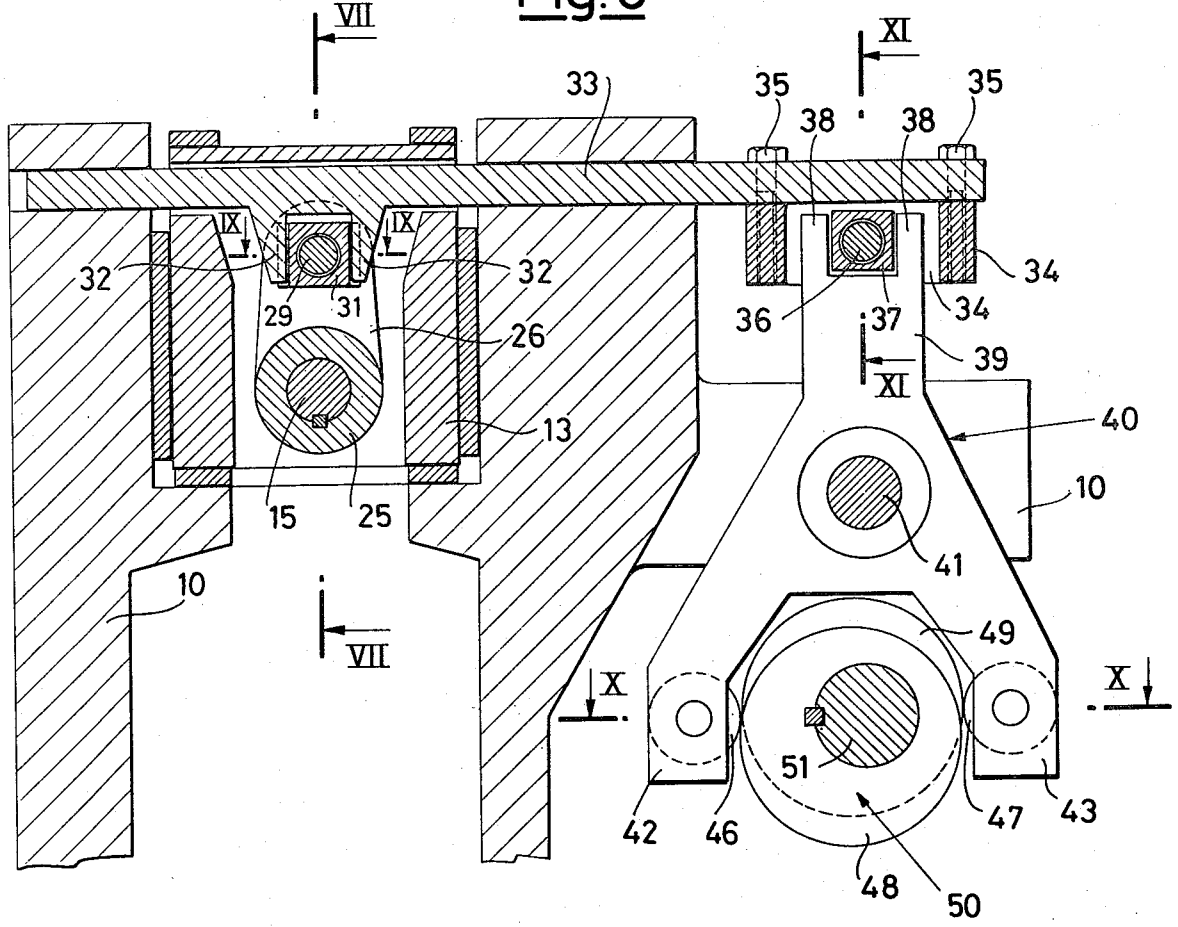
FIG. 8 is a cross-sectional view, taken along the line VIII—VIII of FIG. 7.
Figure 9:
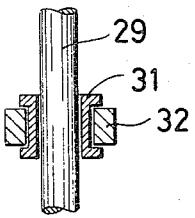
FIG. 9 is a close-up view in cross-section, taken along the line IX—IX of FIG. 8, and FIGS. 10 and 11 show other details in cross-sectional views which are taken along the line X—X and XI—XI of FIG. 8, respectively.

On the pivot 29 is mounted, both for rotation and sliding, a bushing 31 (see also FIG. 9) which engages the two arms of a fork 32 integral with a rod 33. The rod 33 is slidably guided in the casing 10 (see FIG. 8) along a direction perpendicular to the direction of sliding of the ram 13. The space 24 in the ram 13 has such longitudinal dimensions as to allow the ram 13 to go through its reciprocal motion without jamming with the rod 33.

During this stroke of the ram 13, the pivot 29 slides within the bushing 31, whereas the reciprocal motion of the rod 33 causes, via the brushing 31, oscillations of the bracket 25 with its rungs 26, 27 and thus also the tail-piece 15 rocks and so the swinging plate 14 about the axis of the tail-piece 15. The transversal dimensions of the space 24 of the ram 13 are such that, during these oscillations the rungs 26, 27 of the bracket 25 and the fork 32 integral with the rod 33 cannot interfere with the body of the ram 13.

At its end emerging from the casing 10, the rod 33 carries a frame 34 fastened by bolts 35 (FIG. 8) and said frame 34 carries fastened thereto a pivot 36 (FIG. 1). On the pivot 36 is mounted for rotation a bushing 37 having its outer surfaces parallel, which engage the arms of a fork 38 formed at the end of an arm 39 of a lever 40 fulcrumed about an arbor 41 borne by the casing 10. This lever 40 has two additional arms 42, 43, each of which carries in the vicinity of its end, an eccentric pin 44, 45 on which a follower 46, 47, respectively, is mounted. These two followers 46, 47 contact the two complementary profiles 48, 49 of a desmodromic cam 50 keyed to a control shaft 51 of the press.

The rotary motion of the cam 50 is thus converted by the desmodromic linkage into a rocking motion of the lever 40. To make possible the adjustment and the preloading of the linkage and also for taking up possible small backlash, the followers 46, 47 are mounted on eccentric pins 44, 45.

The command of the oscillation of the punch-carrier plate 14 thus takes place as follows.

The rotation, constantly in the same direction, of the shaft 51 of the desmodromic cam 50 causes the lever 40 to swing about the axis of its pivotal point 41. By the coupling between the fork 38 integral with the lever 40 and the bushing 37 borne by the pivot 36 integral with the rod 33, the rocking motion of the lever 40 is converted into a rectilinear reciprocation of the rod 33. The latter, by being engaged through its fork 32 with the bushing 31 carried by the pivot 29 integral with the bracket 25-26-27, originates corresponding oscillations of the bracket and thus also of the tail-piece 15 and of the swinging plate 14 about the axis of the tail-piece 15.

As can readily be seen, the entire linkage for controlling the swinging plate 14 has no resilient means and the rocking motion of the same plate is derived univocally from the rotary motion of the shaft 51 bearing the desmodromic cam 50. By so doing, the utmost accuracy and reliability is obtained and it becomes possible to attain very high working speeds.

The rotation of the control shaft 51 is synchronized, of course, with the reciprocal motion of the ram 13. The latter motion of the ram 13 is obtained conventionally by a linkage composed by a connecting rod 52, a crankshaft 53 and a toggle 54 acting between the casing 10 and the ram 13 (see FIG. 7).

The oscillation of the punch-carrier plate 14 from a working position to the other is carried out partly during the return stroke and partly during the start of the forward stroke of the ram 13.

As can be seen from the foregoing description, the objects aimed at by the invention have been achieved by virtue of the adoption of a swinging plate for the four punches and by virtue of the particular control linkage for said punch-carrier swinging plate.

I claim:

1. A press having two dies and four punches for the production of screws, bolts, rivets and like shaped articles, comprising a casing, a ram with means for imparting thereto a rectilinear reciprocation motion towards and away of the dies, a plate carrying the four punches mounted frontally on said ram, means for shifting said plate on the ram alternately in two working positions, in each of which positions two of the four punches are aligned with the two dies, characterized in that the punch-carrier plate is mounted on the ram by means of a tail-piece having its axis parallel to the direction of reciprocation of the ram so as to be able to oscillate about said axis, and that for the control of the oscillations of the punch-carrier plate a linkage is provided which derives its drive from a cam having desmodromic profiles with which a rocking lever cooperates by means of two followers contacting said profiles.

2. Press according to claim 1, characterized in that each of said followers is mounted on an eccentric pin.

3. Press according to claim 1, characterized in that the rocking lever controlled by said desmodromic cam transfers its drive to a rod slidably guided in rectilinear ways of the casing in the direction perpendicular to the direction of reciprocation of the ram, said rod entering a space formed in the ram wherein it is connected with the possibility of mutual sliding and rotation to a pin parallel to the axis of the tail-piece of the swinging plate, said pin being borne by a supporting member integral with said tail-piece.

* * * * *